US008695962B2

(12) United States Patent
Berni

(10) Patent No.: US 8,695,962 B2
(45) Date of Patent: Apr. 15, 2014

(54) DEVICE AND METHOD FOR GENERATING A CONTROLLABLE RECIPROCAL MOVEMENT OF A MOVEABLE MECHANICAL ELEMENT

(75) Inventor: Claudio Berni, Hombrechtikon (CH)

(73) Assignee: Ferag AG, Hinwil (CH)

( * ) Notice: Subject to any disclaimer, the term of this patent is extended or adjusted under 35 U.S.C. 154(b) by 375 days.

(21) Appl. No.: 13/268,012

(22) Filed: Oct. 7, 2011

(65) Prior Publication Data

US 2012/0085185 A1 Apr. 12, 2012

(30) Foreign Application Priority Data

Oct. 11, 2010 (CH) ..... 1660/10

(51) Int. Cl.

| | |
|---|---|
| ***B65H 3/24*** | (2006.01) |
| ***B65H 3/46*** | (2006.01) |
| ***B65H 3/00*** | (2006.01) |
| ***F16H 27/02*** | (2006.01) |
| ***F16H 29/02*** | (2006.01) |

(52) U.S. Cl.

USPC ..... 271/42; 271/131; 271/135; 221/268; 74/89

(58) Field of Classification Search

USPC ..... 271/42, 131, 132, 133, 135, 99, 3.05, 271/165; 221/268, 272, 275, 253; 74/89, 74/89.21

See application file for complete search history.

(56) References Cited

U.S. PATENT DOCUMENTS

| | | | | |
|---|---|---|---|---|
| 1,725,400 | A * | 8/1929 | Last | 271/10.01 |
| 2,212,993 | A | 8/1940 | Taylor | |
| 3,907,278 | A | 9/1975 | Jaton | |
| 4,181,298 | A | 1/1980 | Capdeboscq | |
| 4,506,875 | A * | 3/1985 | Capdebosco et al. | 271/99 |
| 5,031,892 | A * | 7/1991 | Stieger | 271/10.01 |
| 5,145,161 | A * | 9/1992 | Bowser et al. | 271/12 |
| 5,464,202 | A | 11/1995 | Capdeboscq | |
| 5,690,567 | A * | 11/1997 | DeNijs et al. | 474/73 |
| 5,830,094 | A * | 11/1998 | DeNijs | 474/73 |
| 7,980,420 | B2 * | 7/2011 | Yamamiya | 221/268 |
| 8,056,893 | B2 * | 11/2011 | Mandel et al. | 271/3.21 |
| 2011/0286820 | A1 * | 11/2011 | Chiari et al. | 414/222.02 |
| 2013/0026708 | A1 * | 1/2013 | Shingai | 271/267 |
| 2013/0098560 | A1 * | 4/2013 | Hatano et al. | 156/381 |

FOREIGN PATENT DOCUMENTS

| | | |
|---|---|---|
| DE | 3320491 | 1/1984 |
| DE | 3614683 | 7/1987 |

* cited by examiner

*Primary Examiner* — Patrick Cicchino
(74) *Attorney, Agent, or Firm* — Rankin, Hill & Clark LLP

(57) ABSTRACT

A device for generating a controllable reciprocal movement of a moveable mechanical element between a first stop point and a second stop point. At least one drive element is moved continuously with reciprocal movement between two turning points. A coupling device with a controllable coupling serves for the selective coupling of the mechanical element to the drive element. The coupling device further features a free-wheel and is arranged such that in the active state of the coupling the mechanical element is coupled to the at least one drive element during a first half-cycle of the movement of the drive element and is moved from the first stop point to the second stop point, and during a second half-cycle of the movement of the drive element is substantially uninfluenced by the drive element due to the action of the freewheel.

15 Claims, 13 Drawing Sheets

DEVICE AND METHOD FOR GENERATING A CONTROLLABLE RECIPROCAL MOVEMENT OF A MOVEABLE MECHANICAL ELEMENT

BACKGROUND OF THE INVENTION

1. Field of the Invention

The invention pertains to the field of mechanical engineering and construction as well as to conveyor and processing technology. It relates to a device and a method for generating a controllable reciprocal movement of a moveable mechanical element. The invention is particularly applicable as a singling device for the controllable separation of items from a stack. The items are for example print shop products that are pushed out of a stack of print shop products.

2. Description of Related Art

A shuttle feeder for tabular material is disclosed in DE-A 33 20491. The respective lower item of an item stack is pushed out of the stack by a separation element in such a way that it can be accepted by conveyor belts of an outgoing conveyance device and transported away. The separation element is mounted such that it is linearly moveable and coupled to a driveshaft via an articulation system. The continual rotary motion of the drive shaft is, thus, converted to a linear reciprocal movement of the mechanical element between two stop positions. With this known system one item is pushed out of the stack per rotation of the drive shaft. If one would like to interrupt the removal of items, the drive must be stopped.

In printing technology in particular, but also in other areas of use, it is necessary to select single items on demand, and at precisely timed intervals. In the area of production of newspapers and magazines it is increasingly desired that the main products, e.g. the actual newspaper and/or magazine can be furnished individually with one or more supplements. The supplements are, for example, advertising brochures, flyers, samples, CDs and the like. They can comprise a thickness of 3 mm and more and be rigid, whereby known singling devices, which bend the items during separation, cannot be used. The items are made available in a stack. It is thus necessary to separate these items from the stack in a targeted and temporally precise manner. For this reason the high production cycle of up to 30,000 products per hour should be maintained. At these rates, it is out of the question to turn the drive motors of the singling device and/or the separation element on and off.

Thus another known solution is to couple the separation element by means of a controllable coupling to a continually running drive in order to achieve on-demand separation of an item. In this case the rotary motion of the driveshaft is converted by means of a converter, for example an eccentrically-mounted piston rod, into a reciprocal movement of a drive element, e.g. a piston. The separation element can be coupled to the drive element via a coupling, whereby in a coupled state it is taken along and also describes a reciprocal movement. To prevent rapid deterioration, the coupling must be closed in an unloaded state. The unloaded state exists only at the turning points or turning positions, respectively, of the reciprocal movement of the drive element. The ideal time window for connection is thus very small, whereby either the coupling must be connected under load or the pulse frequency must be limited.

BRIEF SUMMARY OF THE INVENTION

It is an object of the present invention to further develop a singling device of a known type, so that a low-wear use of the coupling is ensured even at high pulse frequencies. In general a drive system for a mechanical element should be made available, with which this can be selectively induced to a reciprocal movement with an externally determined pulse.

The device according to the invention serves for the generation of a controllable reciprocal movement of a moveable mechanical element between a first stop point and a second stop point in an externally-determined pulse. It features at least one drive element which reciprocally moves between two turning positions. The drive element is, for example, coupled to the drive shaft of a motor in such a way that a movement with alternating direction between two stop points/turning positions is made from the continually unidirectional motion of the drive shaft. Furthermore, a coupling device with a controllable coupling is present for the selective coupling-together of the mechanical element to the drive element. In an active (closed) state of the coupling the mechanical element is moved, in an inactive state of the coupling it should remain stationary.

According to the invention the coupling device additionally features a freewheel and is designed in such a manner that if the coupling is active the mechanical element is coupled to the at least one drive element and moved from the first stop point to the second stop point during a first half-cycle of the movement of the drive element. During a second half-cycle of the movement of the drive element, the mechanical element is substantially uninfluenced by the drive element due to the effect of the freewheel. A return guide element is present in order to bring the mechanical element once again to the initial position when the coupling is in its active state. This return guide element moves in a synchronized manner with the at least one drive element. It can at least indirectly act on the mechanical element in such a way that the mechanical element is moved from the second stop point back to the first stop point during the second half-cycle.

For the sake of simplicity, in the following the movement of the mechanical element between the first stop point and the second stop point and the corresponding movement of the drive element are referred to as the forward movement and the movement in the other direction as backward movement.

The freewheel makes it possible that when the coupling is in its closed state, only the forward movement of the at least one drive element is transmitted to the mechanical element and the coupling thereby placed under load. The backward movement of the drive element is decoupled from the mechanical element, whereby the coupling is unloaded during the backward movement. The coupling device, thus, only selectively transmits the forward movement of the drive element onto the mechanical element and in addition only when the coupling is active. The coupling is thus unloaded in the second half-cycle and can consequently be switched (activated and/or de-activated) without load. The return guide element is fundamentally not coupled to the drive element by means of the controllable coupling, but rather by other means, e.g. it is attached to the drive element or firmly connected to it. Here, and throughout this application, the term 'connected' indicates that the movements of connected parts are coupled at least some of the time. The return guide element transmits the backward movement of the drive element onto the mechanical element. For this reason the mechanical element, if it left the first stop point in the first half-cycle, proceeds from the second stop point to the first stop point independent of the state of the coupling during the second half-cycle.

Compared to the conventional case, the invention makes it possible to significantly increase the time during which the unloaded closing of the coupling is possible, namely by half of the pulse length and/or the entire second half-cycle over and above a fraction of the pulse duration if it were closed at the turning points. Consequently, shorter pulse durations and/or larger numbers of pulses are possible than with conventional systems.

The reciprocal movement of the drive element can be a rotation around a small angle or also a linear movement. Movements along defined curves between two stop points can also be achieved by known mechanical converters and/or guides of the drive element or of the mechanical element. As an example, a piston which is eccentrically connected to the drive shaft by means of a piston rod serves as the drive element. The reciprocal rotation of the piston rod can be transferred to further components by means for transmitting force, for example a toothed belt; toothed belts and further components are thus also drive elements in the sense of the invention if they change direction as they move between two stop points. The mechanical element is selectively coupled to one of the components which move reciprocally.

The coupling device can be mechanically realized by different methods. The coupling device can, for example, be arranged in a moveable carriage together with the separation element. The coupling device can also be integrated such that it is spatially separated from the mechanical element, for example in a reverse sprocket for a toothed belt that is used for transmitting force. In both cases, the freewheel serves to prevent transmission of force from the drive element to the mechanical element during the backward movement of the drive element. During the forward movement the drive force is only transmitted if the coupling is in its active state. If the coupling is in its inactive state, no force is imparted on the mechanical element either. The mechanical element is thus not set in motion or activated by other means.

The coupling device preferably features a shaft, which is arranged such that it can rotate. The freewheel is situated between the shaft and the drive element, whereby a drive force can be transmitted to the shaft only in one direction and/or only in the first half-cycle. The controllable coupling is present between the separation element and the shaft and selectively couples the mechanical element to the shaft, whereby the shaft can transmit the drive force to the mechanical element. The coupling is achieved directly or indirectly via a means of transmitting force. In the opposite direction no force is transmitted from the shaft. This thus remains at its turning point at the end of the first half-cycle. The mechanical element is, if necessary, brought back to the starting position by means of the return guide element. The shaft is also not turned during the return guidance. In this way no force acts upon the coupling during the return guidance.

Toothed belts are preferably used for the transmission of force. Other transmission mechanisms are of course possible, for example via friction locking or with fixed coupling elements, for example coupled cranks.

The return guide element is, for example, a slide that moves the mechanical element by pushing upon it. It can, however, also pull the mechanical element back to the starting position.

In a first preferred embodiment the coupling device is moveable together with the mechanical element, in particular integrated in a shared carriage. The transmission of force occurs via a toothed belt which moves over a crown gear. The crown gear is in turn firmly connected to an outer ring of the freewheel. An inner ring of the freewheel is firmly coupled to the shaft. The shaft is arranged such that it can rotate in the carriage. The free rotation of the shaft relative to the carriage can be blocked by means of the coupling.

For this example the movements of the components involved in the first half-cycle are described in the following: the mechanical element and the carriage are situated at the first stop point. In the first half-cycle the drive element, here the toothed belt, is moved in the forward direction. The return guide element also moves with the drive element. The freewheel, blocked by this movement of the toothed belt, i.e. the outer ring taking the inner ring along with it and thus also transmits force to the shaft. If the coupling is not closed, the shaft rotates freely in the carriage. The carriage thus remains stationary. If the coupling is closed, it blocks the free rotation of the shaft. The crown gear can therefore no longer rotate freely in the carriage, whereby the carriage follows the movement of the toothed belt, is moved in the forward direction, and reaches the second stop point.

In the second half-cycle the toothed belt moves in the backward direction. If the coupling is in its unclosed state the carriage is still located at the first stop point. With a movement in the backward direction the inner and outer rings of the freewheel are decoupled. Therefore the toothed belt cannot transmit any force to the shaft during the entire second half-cycle. If the coupling is in its unclosed state the carriage is situated at the first stop point at the beginning of the second half-cycle. It remains there during the entire second half-cycle. If the coupling is in its closed state the carriage is situated at the second stop point at the beginning of the second half-cycle. The backward movement of the toothed belt is decoupled from the shaft by the freewheel independent of the state of the coupling, whereby the toothed belt does not directly pull the carriage back to the first stop point. The carriage is in this case pushed back to the rear stop point by the return guide element. The coupling is thus unloaded during the backward movement, independent of the state of the coupling. The entire second half-cycle can be used for unloaded closing of the coupling. The control device of the system sends closing signals to the coupling, which signals take effect during the second half-cycle.

In a second preferred embodiment the coupling device is stationary, in particular integrated into the housing in which the other mechanical element is mounted. The transmission of force again occurs via a toothed belt which is firmly connected to the mechanical element and passes over a crown gear. The crown gear is mounted on a shaft such that it can rotate. The shaft is mounted in the housing such that it can rotate. The free rotation of the crown gear relative to the shaft can be blocked by means of the coupling. A piston that is set in reciprocal movement serves here as a drive element. It is also attached to the shaft via the freewheel. The inner ring of the freewheel is connected to the shaft, and the outer ring of the freewheel is connected to the piston.

For this example the movements of the components involved in the first half-cycle are described in the following: the mechanical element and the toothed belt are situated at the first endpoint. The drive element—here the piston—is turned in the forward direction. In this direction the freewheel is blocked—i.e. its movement also moves the shaft. If the coupling is not active, the shaft can rotate relative to the crown gear; in the active state of the coupling this rotation is blocked. The crown gear is thus only moved along with the drive element if the coupling is closed, whereby the mechanical element is moved to the second stop point. If the coupling is inactive, the toothed belt and thus also the mechanical element remain at the first stop point. In the second half-cycle the freewheel decouples the piston from the shaft, whereby the shaft remains uninfluenced by the backward movement of the piston. The shaft is however turned back to the starting position, if it has previously left, by a return guide element. Therefore in this embodiment the coupling is again unloaded during the backward movement, independent from its state. The entire second half-cycle can be used for unloaded closing of the coupling. The control device of the system sends closing signals to the coupling, which signals take effect during the second half-cycle.

To prevent dynamic unbalance from the use of the mechanical element, a mass-balancing mass, which is also moved at least if the mechanical element is moved, is preferably also present. When force is transmitted by means of toothed belt, the balancing mass is preferably attached to the inactive side of the toothed belt. Solutions in which the toothed belt is not continually moved, as e.g. the two embodiments described above, achieve by virtue of their design the advantage that the balancing mass oscillates back and forth even when the mechanical element remains still.

The coupling, for example a controllable magnet coupling, receives control signals from a control device. The time window within which the control signals must reach the coupling is increased considerably by the invention. The control device is configured in such a manner that its control signals are received by the coupling during the second half-cycle.

In order to stop the backward movement of the mechanical element or attenuate shocks, a shock absorber is preferably present, which acts on the mechanical element, or a component firmly fixed thereto as for example a carriage, at the first stop point. It is also possible to provide an energy storage mechanism that can absorb energy from the moving parts and in particular from the mechanical elements and can release it directly or indirectly back to the same parts. In particular, the energy storage mechanism need not return the energy immediately after absorbing it but can store it for a certain period.

Optionally, the energy storage mechanism can absorb, release and, in particular store different forms of energy.

There is a further option of the energy storage mechanism converting types of energy at least once, in particular twice. For example, as energy is absorbed in the energy storage mechanism, a first form of energy is converted into a second form of energy and stored as such, and converted back into the first form of energy as it is released.

In particular, the first form of energy is kinetic energy and the second form of energy is potential energy. The kinetic energy of the moving parts might e.g. be converted initially into another form of energy and subsequently be supplied to the energy storage mechanism, and vice versa. Different forms of energy are e.g. kinetic, potential, chemical, thermal and electric energy.

The energy storage mechanism can e.g. comprise springs and/or spring assemblies, in particular spiral springs, coil springs, spiral pressure springs, torsion springs, leaf springs, hydraulic springs and/or other bending, tension and gas springs. The energy storage mechanism can e.g. comprise gyros, flywheels and/or other rotating mass storage. The energy storage mechanism may also comprise batteries, accumulators, condensers and/or other storage devices for electric energy, in particular in connection with at least one electromechanical converter. The energy storage mechanism can absorb and supply the energy of the backward and/or forward movement. The absorption, release and, in particular, storage of the energy in the energy storage mechanism occurs in particular when the mechanical element is close and/or adjacent to at least one stop point. Close to a stop point in this case implies that the mechanical element is located within a given scope around the stop point.

If the mechanical element is not to be activated for a known time, a retention element can preferably be activated. The retention element exerts a force upon the mechanical element at the first stop point which opposes that of the drive force. In this way it holds the mechanical element at the first stop point and prevents it from leaving the stop point due merely to vibrations of the system. The retention element is, for example, realized by means of an electromagnet or by a moveable permanent magnet that can selectively be switched on. The retention element can e.g. comprise a further controlled coupling. An energy storage mechanism can also at least partly function as a retention element.

The drive system according to the invention, thus selective coupling to the outward movement of a reciprocally moving drive element by means of a coupling, fundamental decoupling from the backward movement by means of a freewheel as well as return pushing by means of a pusher that is moved along with the drive element, can be used in all processes in which the rapid movement of a mechanical element in a predetermined pulse must be achieved. The mechanical element can be a part of a superordinate system. Furthermore, the drive system according to the invention can feature further components which execute a rectified movement, e.g. a drive shaft and/or a motor, wherein via an appropriate coupling the drive element is moved in a continual reciprocal movement in the desired pulse by these components. The coupling device with the controllable coupling and the freewheel acts between the at least one mechanical element that is only moved on demand and the drive element that is continually moving back and forth.

The drive device is preferably arranged for driving a separation element of a singling device for items. The separation element can move between the first stop point and the second stop point and can therefore act on an item in a stack in order to separate this item from the stack. The separation element is, for example, a pusher and/or a suction cup and/or works by means of friction.

In order to simplify handling and/or merge production streams, two or more singling devices can be planned in parallel to single out successively alternating items as required (splitting mode). This is advantageous, for example, if items from a stack should be singled, which are so thick that the stack column would quickly be emptied by a normal 1:1 operation.

BRIEF DESCRIPTION OF THE DRAWINGS

Examples of the invention are depicted in the drawings and described in the following. Shown are.

DETAILED DESCRIPTION OF THE INVENTION

The figures depict a shuttle feeder, thus a singling device, in which the drive system according to the invention is integrated and used to drive a separation element. The separation element is a combined pusher and suction element, with which planar items, e.g. print shop products can be pushed out of a stack from below. The principle of drive and coupling for the separation element that is described in the following is however not limited to this application, but rather is fundamentally applicable to all quickly triggered movements that must occur in a predetermined pulse.

Figure 1:
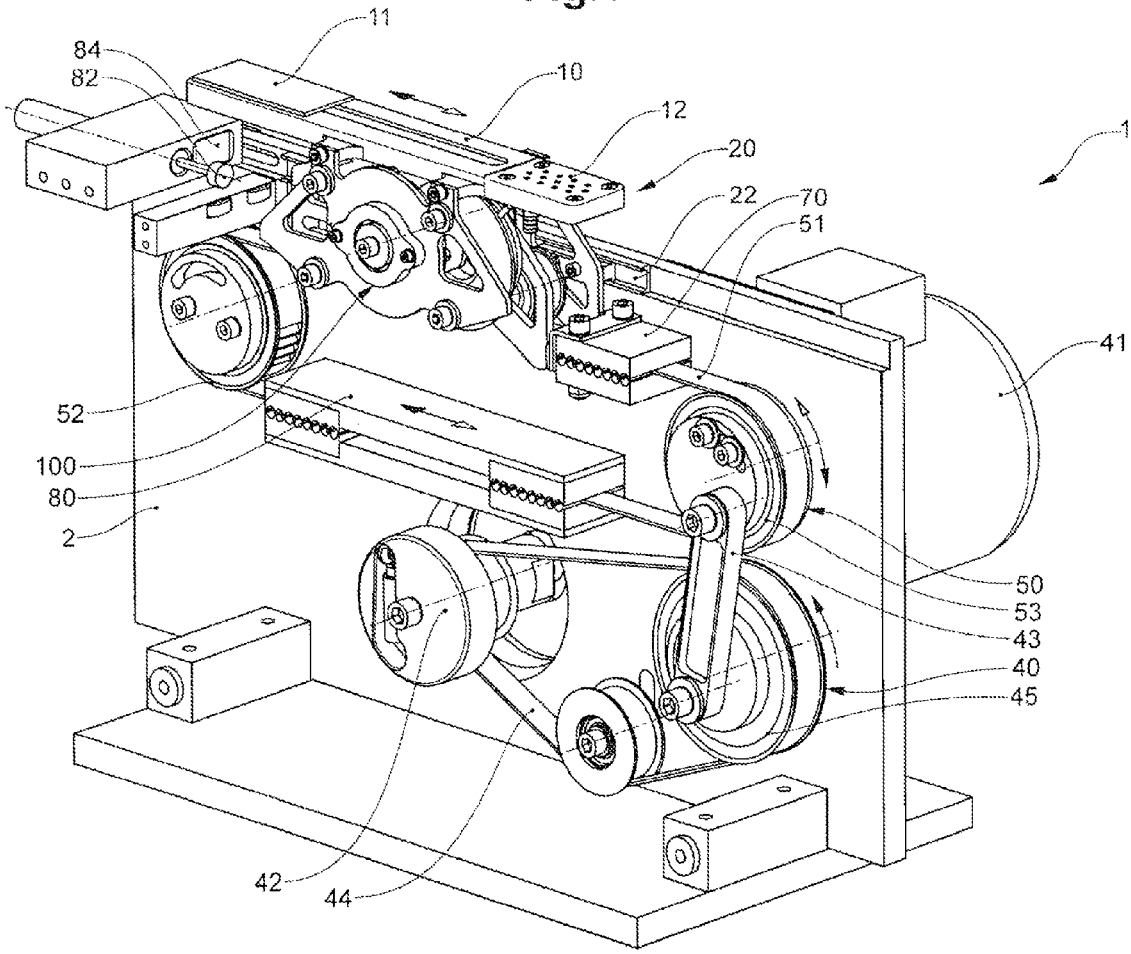
FIG. 1 a three-dimensional view of a first embodiment of a singling device, in which the coupling device is integrated into a carriage for the separation element.
Figure 2:
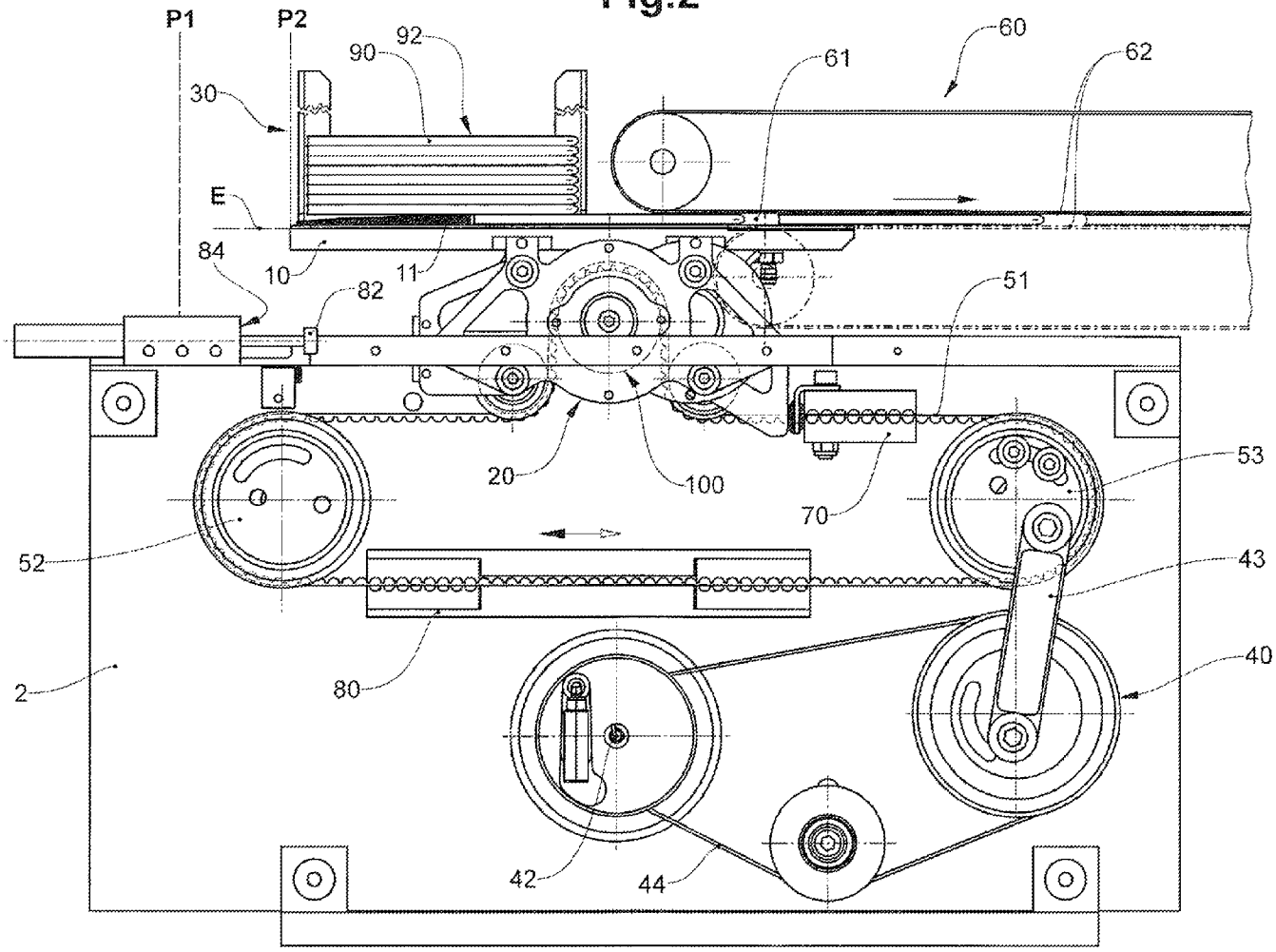
FIG. 2 the singling device from FIG. 1 in side view, wherein the separation element is situated at the second, that is front stop point.
Figure 3:
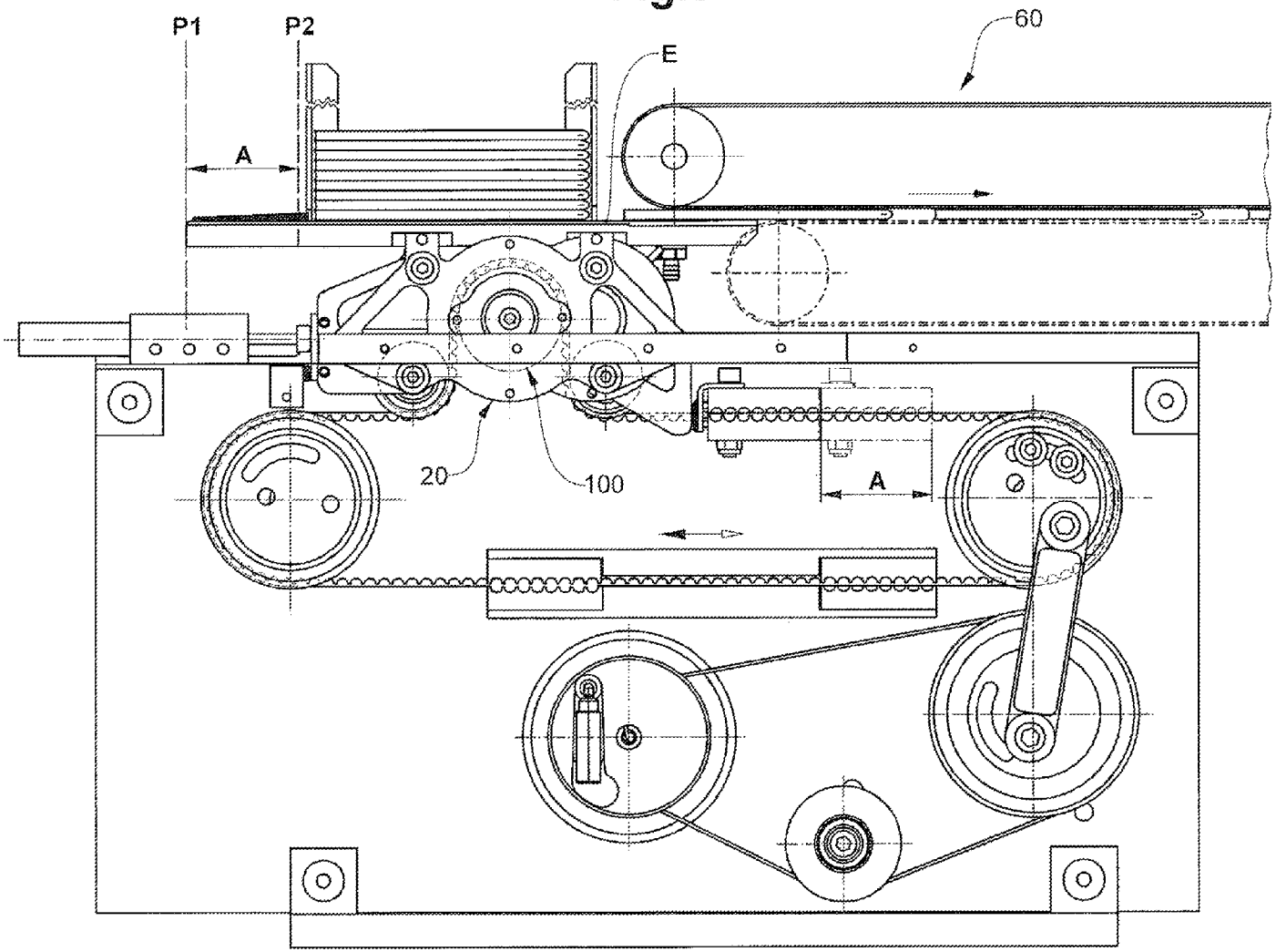
FIG. 3 the singling device from FIG. 1 in side view, wherein the separation element is situated at the first, that is rear stop point.

FIGS. 1-3 depict an overall view of a first embodiment of the singling device 1. It features a housing 2 not shown in detail here, on and/or in which the separation element 10 as well as the drive system are mounted. In addition a stack feeder 30 for items 90 as well as an outgoing conveyance feature 60 for the separated items 90 are present. The separation element 10 is arranged in a carriage 20 and firmly connected to the carriage 20. In addition, the carriage 20 features the coupling device 100. The carriage 20 is arranged so that it can move in a horizontally-arranged guide slit 22 within the housing 2. By means of reciprocal movement of the carriage 20 the separation element 10 moves with a stroke A between a first, that is rear stop point P1 (FIG. 3) and a second, that is front stop point P2 (FIG. 2).

The drive system features on one side a first part 40, whose components move through a rectifying movement: a motor 41 continually turns a drive shaft 42. Its rotary motion is transmitted to a wheel 45 by means of a corresponding transmission element, here belt 44. A converter 43, here a piston rod, transmits the movement to a second part 50 of the drive system. The components of the second part 50 of the drive system execute a reciprocal movement: a piston 53 is induced to move by the piston rod 43 in a rotational movement with changing direction about an angle. The piston 53 is formed as a crown gear, over which is a toothed belt 51 runs for transmitting force to, among other things, the carriage 20 and/or the coupling device 100. The toothed belt 51 will therefore also move in a reciprocal movement. A return guide element 70 and a balancing mass 80 are firmly connected to the toothed belt 51. The return guide element 70 is situated at the active side of the toothed belt 51, i.e. on the side of the carriage 20, while the balancing mass 80 is present on the inactive side.

A third part of the drive system for the separation element consists of the components which only carry out a movement when the coupling is closed. This part features here the carriage 20 and the separation element 10 that is connected thereto. The coupling device 100 acts between the second and third part.

The separation element 10 features a pusher 11 which moves approximately in the plane E of the stacking base and, thus, can push the lowermost item 90 of the stack 92 out of the stack 92. Furthermore a suction element 12 is present, which is moved with the pusher 11 and can suction onto the underside of the items 90. The connection to the vacuum source can be controllably interrupted and/or established. Approximately in the same plane E as the lowermost item 90 is a conveyance gap 61 of the outgoing conveyance device 60, which here is formed from two or more conveyor belts 62 that are driven in opposite directions.

The movement of the carriage 20 back to the rear stop point P1 is damped by a shock absorber 82. The carriage can be held in this position by a retention element 84 that can be activated. The retention element 84 is, for example, a permanent magnet that preferably can be automatically moved by a known drive means between an active and an inactive position, i.e. can be switched on or off by means of a control signal.

Figure 4B:
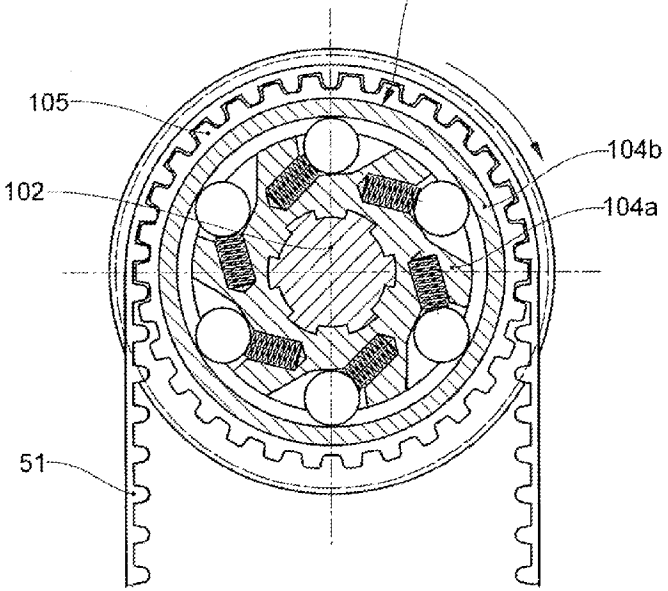
FIGS. 4*a* and 4*b* cross sections of the coupling device used in FIGS. 1-3.
Figure 4A:
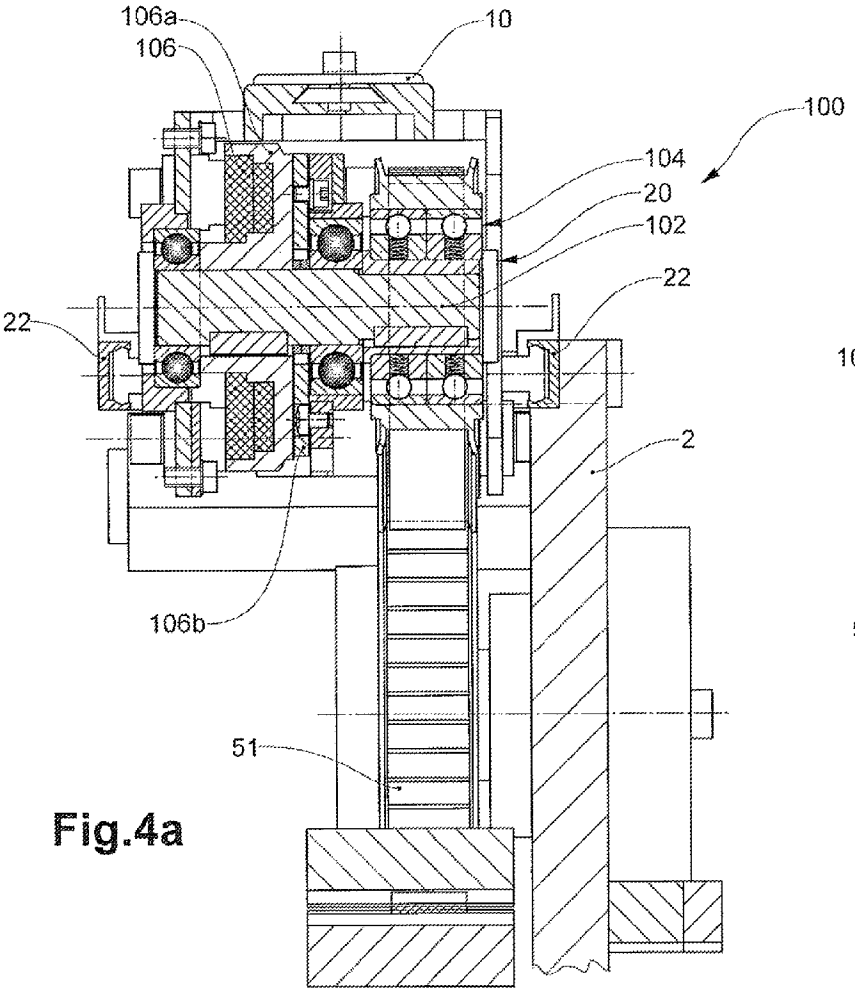
Figure 5:
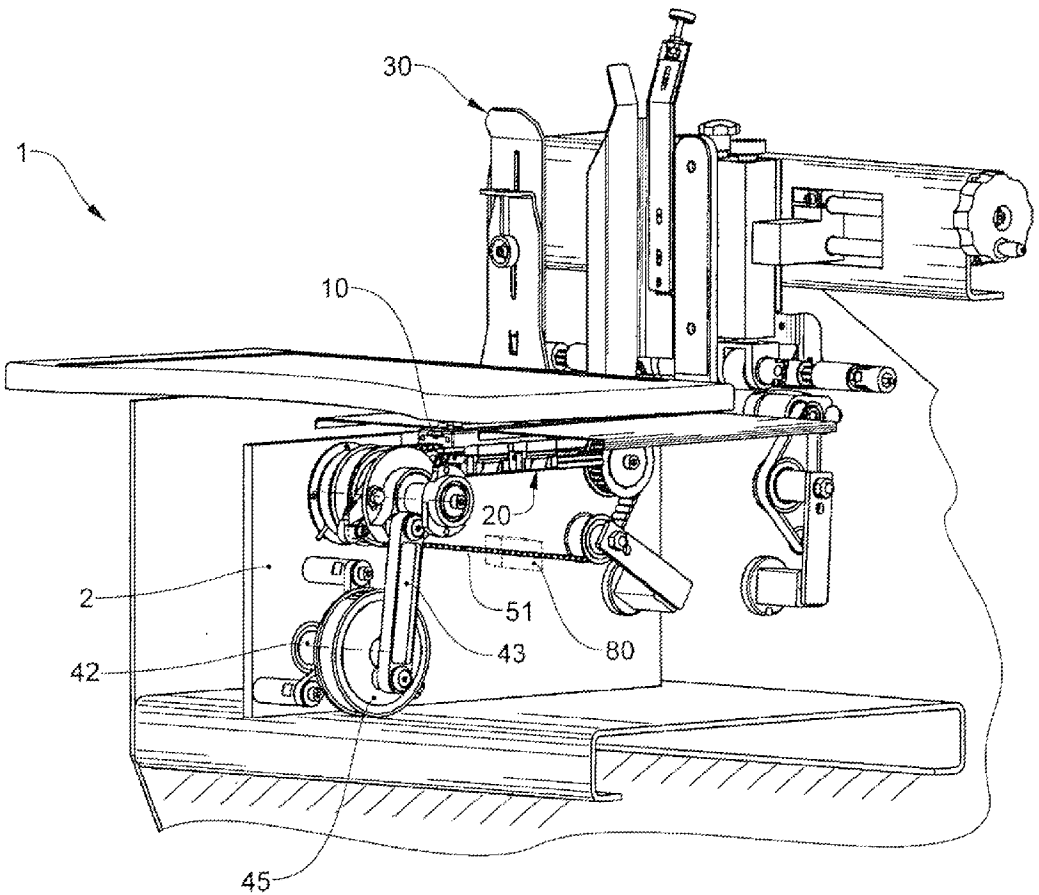
FIG. 5 a three-dimensional view of a second embodiment of a singling device, in which the coupling device is integrated in a reverse sprocket for a toothed belt.
Figure 6:
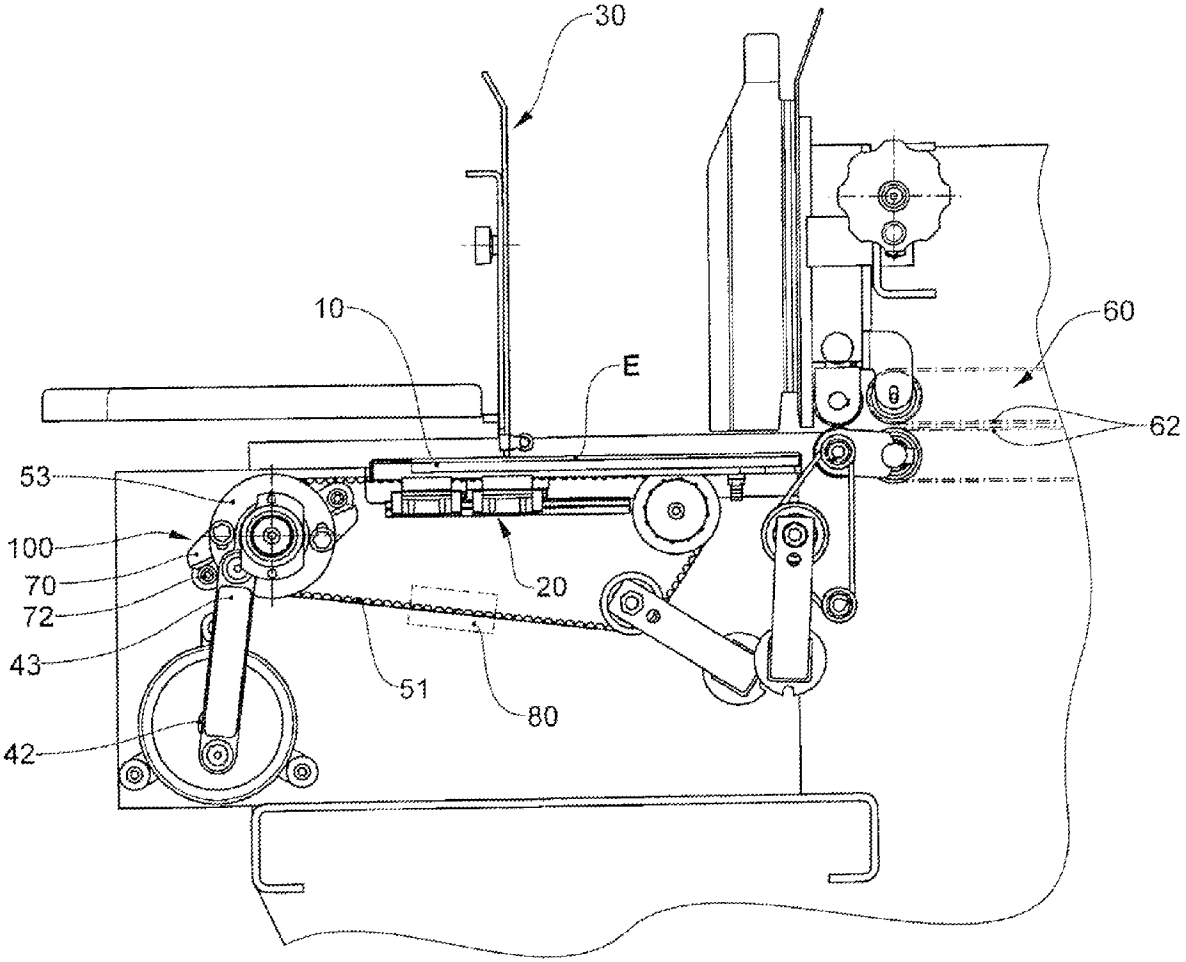
FIG. 6 a side view of the singling device from FIG. 5.

In the following the construction of the coupling device 100 will be described with further reference to FIG. 4*a* and FIG. 4*b*: the coupling device 100 features a freewheel 104 as well as a controllable coupling 106, e.g. a magnetic coupling with coupling socket 106*a* and coupling disc 106*b*. Freewheel 104 and coupling 106 are arranged on a common shaft 102, which is mounted so that it can rotate in the carriage 20. FIG. 4*a* depicts a carriage along the axis of the shaft 102. FIG. 4*b* shows a cross-section through the freewheel 104 perpendicular to the axis of the shaft 102. The inner ring 104*a* of the freewheel 104 and the coupling socket 106*a* are firmly connected to the shaft 102. The coupling disc 106*b* is connected to the carriage 20, but in the unclosed state of the coupling 106 can rotate freely relative to the shaft 102. The radially outward ring 104*b* of the freewheel 104 bears a crown gear 105 over which the toothed belt 51 passes.

The following describes the movements of the components involved in the first half-cycle (clockwise movement of the toothed belt 51): the carriage is situated at the rear stop point P1 (FIG. 3). In the first half-cycle the toothed belt 51 describes a movement of stroke A, clockwise in the view shown in FIGS. 1-3 and FIG. 4*b* (see indicated direction in FIG. 4*b*). The return guide element 70 also moves with the toothed belt 51 in stroke A. The freewheel 104 blocks due to a clockwise movement, i.e. the outer ring 104*b* moves with the inner ring 104*a* in the first half-cycle and hence also transmits force to the shaft 102. If the coupling 106 is not closed, the shaft 102 rotates freely in the carriage 20 in the first half-cycle. The carriage 20 thus remains at P1. If the coupling 106 is closed, it blocks the free rotation of the shaft 102. The crown gear 105 can therefore no longer rotate freely in the carriage 20 during the first half-cycle, whereby the carriage 20 follows the movement of the toothed belt 51. The carriage 20 is thus pulled to the right, and the separation element 10 moves from the rear stop point P1 to the front stop point P2. In the front stop point P2 the carriage 20 strikes against the return guide element 70.

The following describes the movements of the components involved in the second half-cycle (counterclockwise movement of the toothed belt 51): The toothed belt 51 describes a movement counterclockwise with the stroke A. In an unclosed state of the coupling 106, the carriage 20 is still situated at P1. A counterclockwise movement or as the case may be a movement in the opposite direction of the arrow in FIG. 4*b* decouples the inner and outer rings 104*a*, 104*b* of the freewheel 104. The outer ring 104*b* rolls upon the inner ring 104*a*. The toothed belt 51 can thus transmit no force to the shaft 102. In the unclosed state, the carriage remains at P1. Since no force is transmitted to the shaft, the entire second half-cycle can be used for closing the coupling. In a closed state of the coupling, the carriage is situated at the front stop point P2 at the beginning of this second half-cycle. As in the unclosed state the backward movement of the toothed belt 51 is decoupled from the shaft 102 by the freewheel 104, whereby the toothed belt 51 does not pull the carriage 20 directly back to the stop point P1. The carriage 20 is in this case pushed back to the rear stop point P1 by the return guide element 70, which also joins in the return stroke of the toothed belt 51. The coupling 106 is therefore also unloaded during its backward movement in a closed state, and the entire second half-cycle can be used to operate the coupling 106.

To avoid dynamic imbalance during movement of the carriage 20 a balancing mass 80 is mounted on the inactive side of the toothed belt 51. This moves continually back and forth with the toothed belt 51.

FIGS. 5-8 depict the second embodiment of the invention, in which the coupling device 100 is spatially separated from the separation element 10. The separation element 10 is again arranged on a carriage 20 and moveable in a guide. The continual unidirectional movement of a driveshaft 42 is converted by means of a piston rod 43 to a reciprocal movement of a piston 53. A toothed belt 51 serves to transmit force to the carriage 20. In this embodiment, the toothed belt is firmly connected to the carriage 20. The toothed belt runs over reverse sprockets. The coupling device 100 is integrated into one of the reverse sprockets. The coupling device is therefore stationary and is not moved with the carriage 20.

As in the first embodiment, the drive system features a first part whose components execute a rectified movement, a second part, whose components execute a continual reciprocal movement, as well as a third part, whose components only move reciprocally if the coupling is closed. The coupling device acts between the second and third parts. The first part features a motor (not shown here), drive shaft 42 and a wheel 45, on which the piston rod 43 is mounted. The second part here features only the piston 53 as well as the return guide element 70 that is arranged thereon, which here is designed as a drive cam. The third part of the drive system features among other things the carriage 20 and the toothed belt 51.

Figure 7:
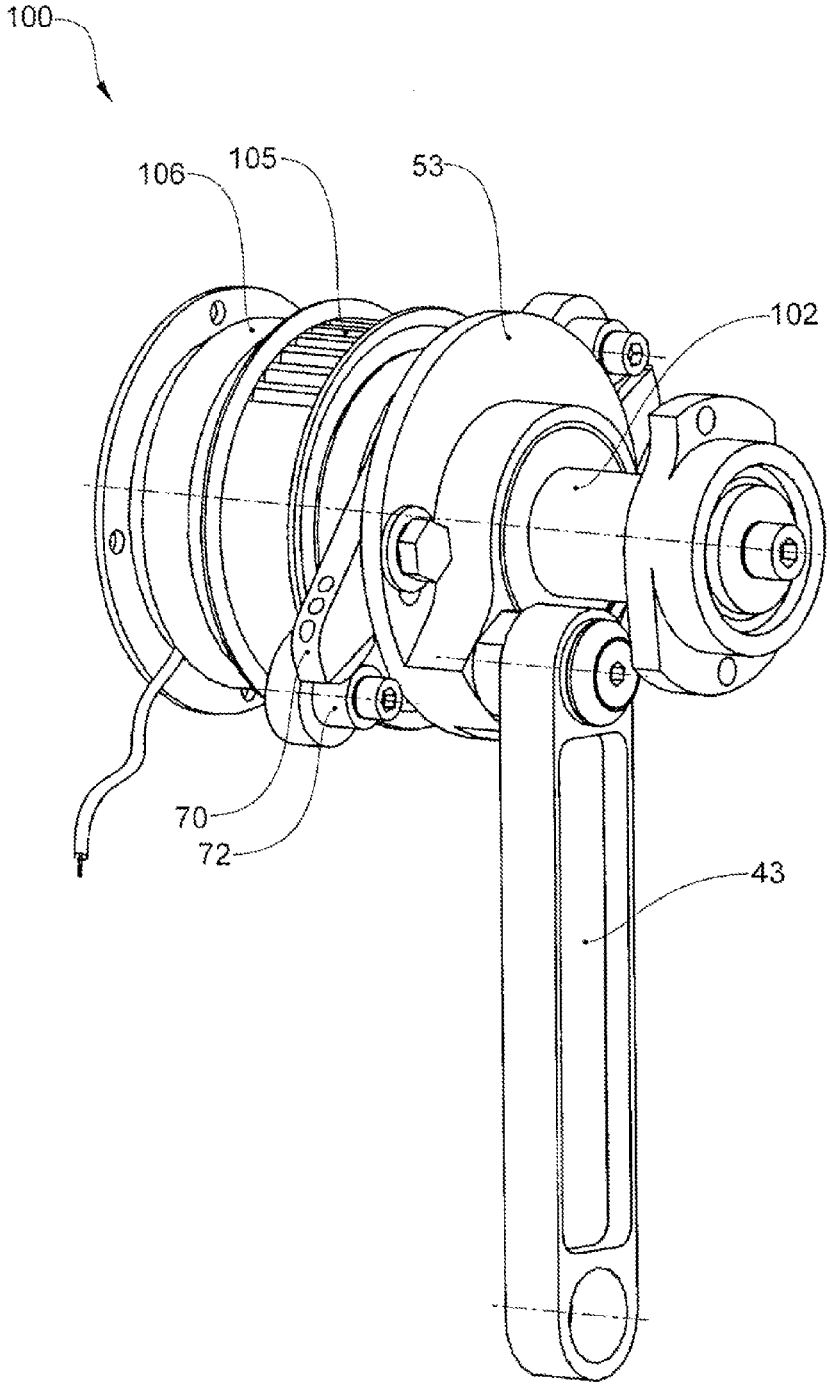
FIG. 7 a three dimensional view of the coupling device used in FIG. 5 and FIG. 6.
Figure 8:
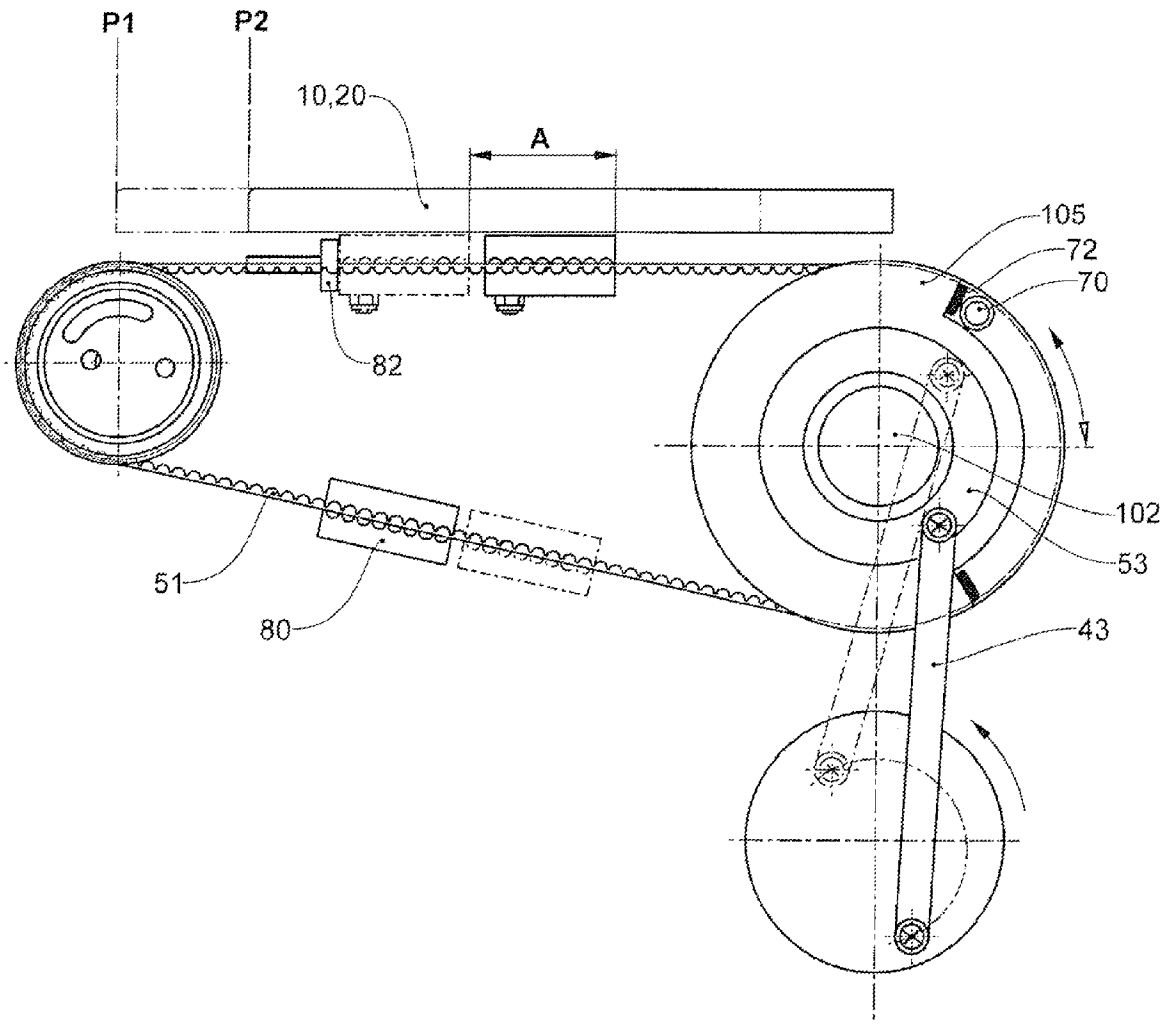
FIG. 8 a side view of a drive system of the singling device from FIG. 5.
Figure 9:
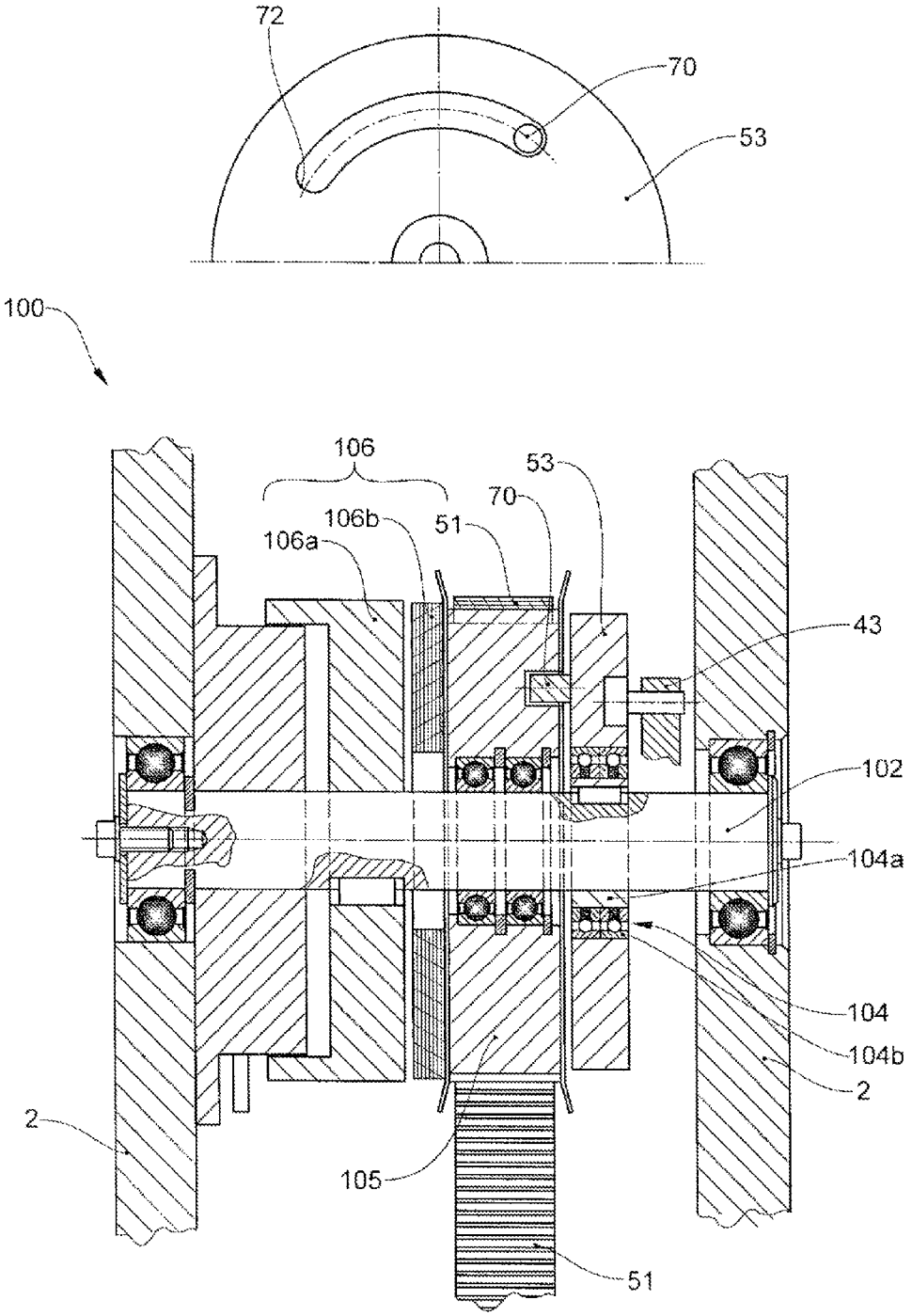
FIG. 9 a cross section of the coupling device used in FIGS. 5-8.

The construction of the coupling device 100 is described in the following with reference to FIGS. 7-9: the piston 53 is arranged on a shaft 102, which is arranged so that it can rotate in housing 2. A freewheel 104 whose inner part 104*a* is firmly connected to the shaft 102 is integrated into the piston 53. The piston rod 43 is firmly connected to the outer part 104*b* of the freewheel 104. Coaxial with the freewheel 104 is a crown gear 105 as well as a coupling 106 with coupling socket 106*a* and coupling disc 106*b*. The coupling socket 106*a* is firmly connected to the shaft 102. The crown gear 105 can rotate freely with respect to the shaft 102 itself. The free rotation of the crown gear 105 can be blocked by the coupling 106.

The return guide element 70 is firmly connected to the piston 53. The crown gear 105 comprises an appropriately designed opposing element 72 that can interact with the return guide element 70. The opposing element 72 is in the case of FIG. 8 and FIG. 9 a side wall of a groove and in the case of FIG. 7 an axially projecting peg.

The following describes the movements of the relevant components in the first half-cycle (clockwise movement of the piston 53): The carriage is situated at the rear stop point P1 (FIG. 8). The piston 53 is turned a defined angle in the clockwise direction by the drive. The freewheel 104, which is built as in FIG. 4*b*, is blocked from moving in the clockwise direction, whereby the shaft 102 is also turned. If the coupling 106 is not active, the crown gear 105 remains stationary. The toothed belt 51 is, thus, not moved, and the separation element 10 remains at P1. If the coupling 106 is closed, the crown gear 105 rotates together with the shaft 102 and the toothed belt 51 moves through stroke A. The active side of the toothed belt 51 is thus also moved through the stroke A to the right. Since the separation element 10 is firmly connected to the toothed belt 51, it is also moved to the right and reaches the front stop point P2.

In the second half-cycle (counter-clockwise movement of piston 53), the freewheel 104 decouples the piston 53 from the shaft 102. If the coupling was not previously closed, the separation element 10 remains at P1. If the coupling 106 was previously closed, the crown gear 105 is turned back to its starting position by the drive cam 70 which interacts with the opposing element 72 on the crown gear 105. The toothed belt 51 also rotates with it and moves the separation element 10 once again to the rear stop point P1.

To avoid dynamic imbalance, a balancing mass 80 is mounted at the inactive side of the toothed belt 51. As in the first embodiment, shock absorbers 82 and/or retention elements 84 can be present.

In the second embodiment, the masses of those components that are continuously moved back and forth are reduced. In principle this applies only to the piston that describes a reciprocal movement. The moved masses are mostly systematically split, because the balancing mass is only moved if the carriage is also moved. This has the advantage of reducing the dynamic imbalance.

Figure 10:
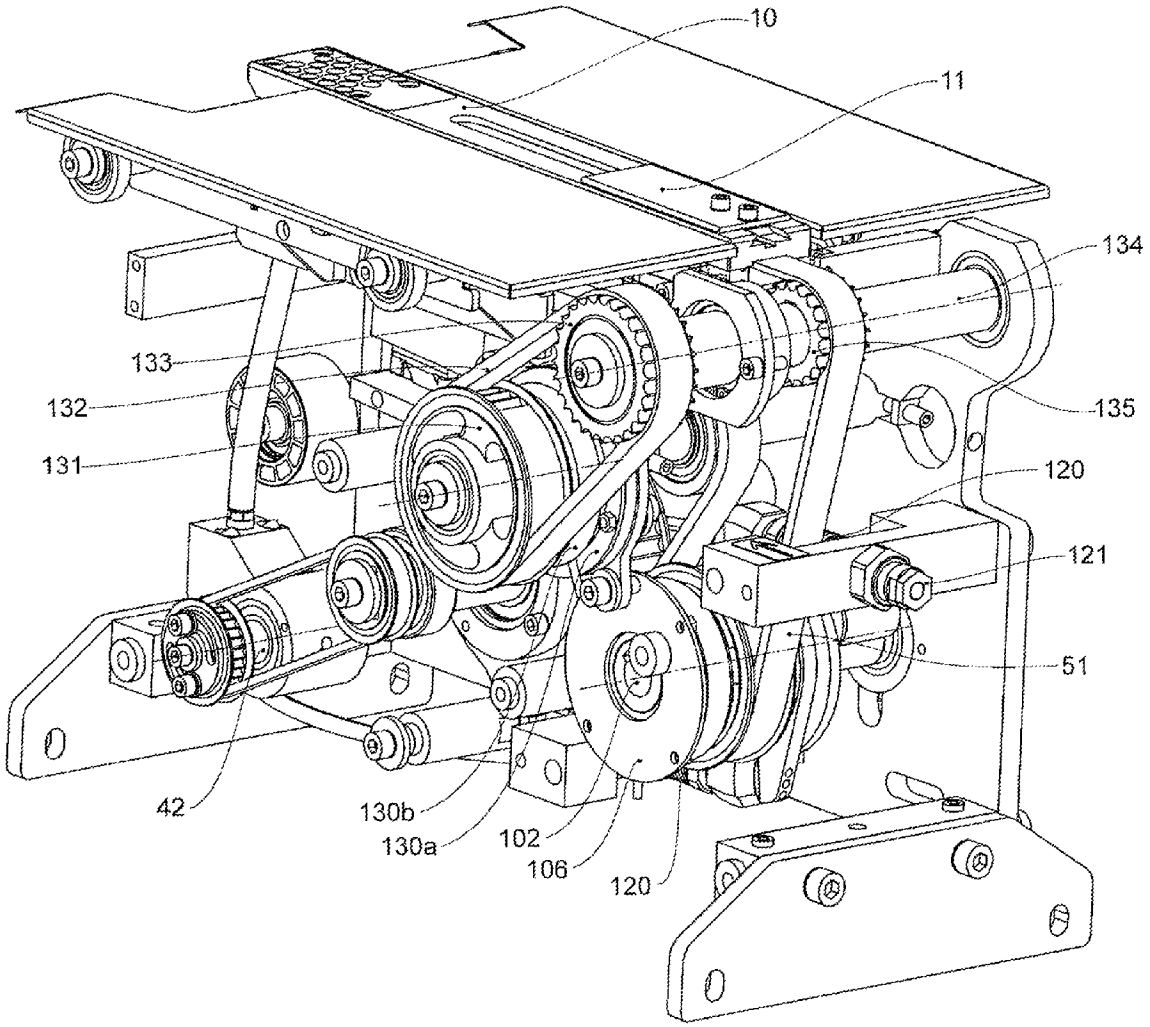
FIG. 10 a three-dimensional view of a third embodiment of a singling device, wherein an energy storage mechanism is integrated.
Figure 11:
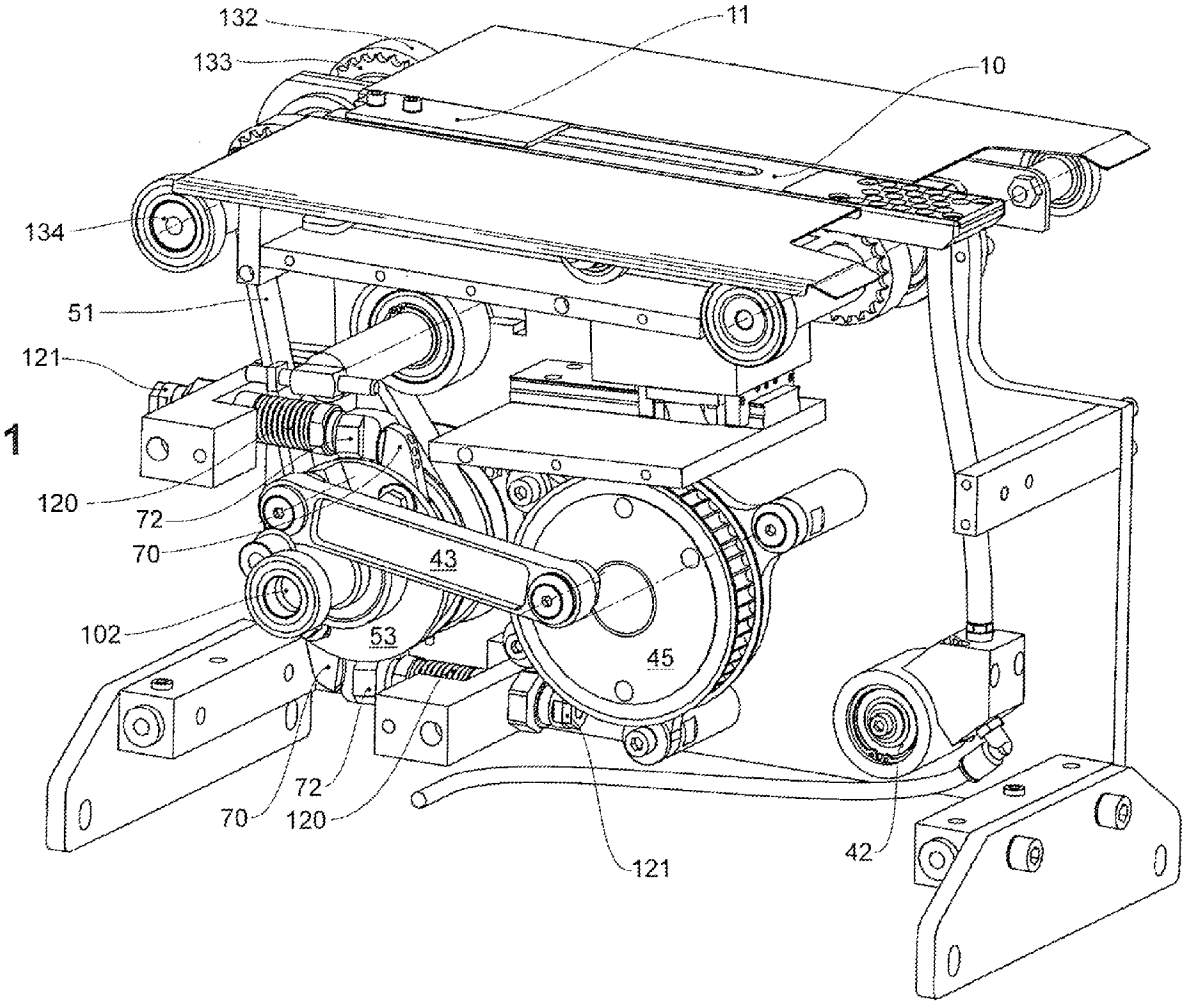
FIG. 11 a three-dimensional view of the singling device in FIG. 10 from another side.

A third embodiment is depicted in FIGS. 10-13. FIG. 10 and FIG. 11 show the third embodiment from two different sides. The basic construction of the drive system is similar to the one in the second embodiment. In the third embodiment the separation element 10 is firmly coupled with the toothed belt 51. Like in the second embodiment, the toothed belt 51 is connected to the piston 53 via the coupling 106 and the (not visible) freewheel, and the piston 53 is firmly connected with two return guide elements 70 that can cooperate with two counter elements 72. The piston 53 is connected to the drive pulley 45 via the connecting rod 43. The toothed belt 51 of the third embodiment is driven, controlled and moved like the toothed belt 51 in the second embodiment.

Figure 12:
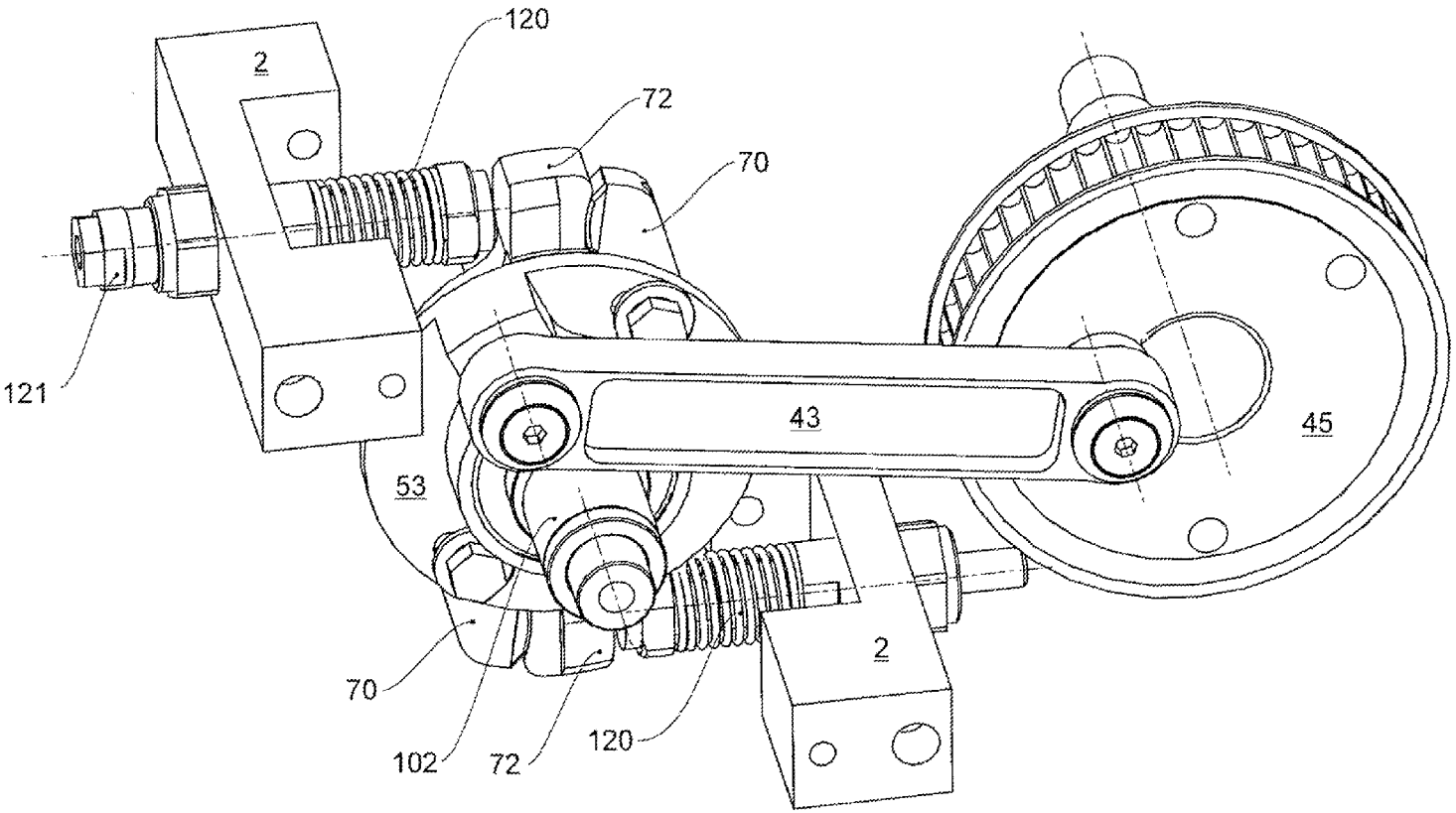
FIG. 12 a three-dimensional view of a first part of the energy storage mechanism used in FIG. 10 and FIG. 11 (viewed from the same side as in FIG. 11)
Figure 13:
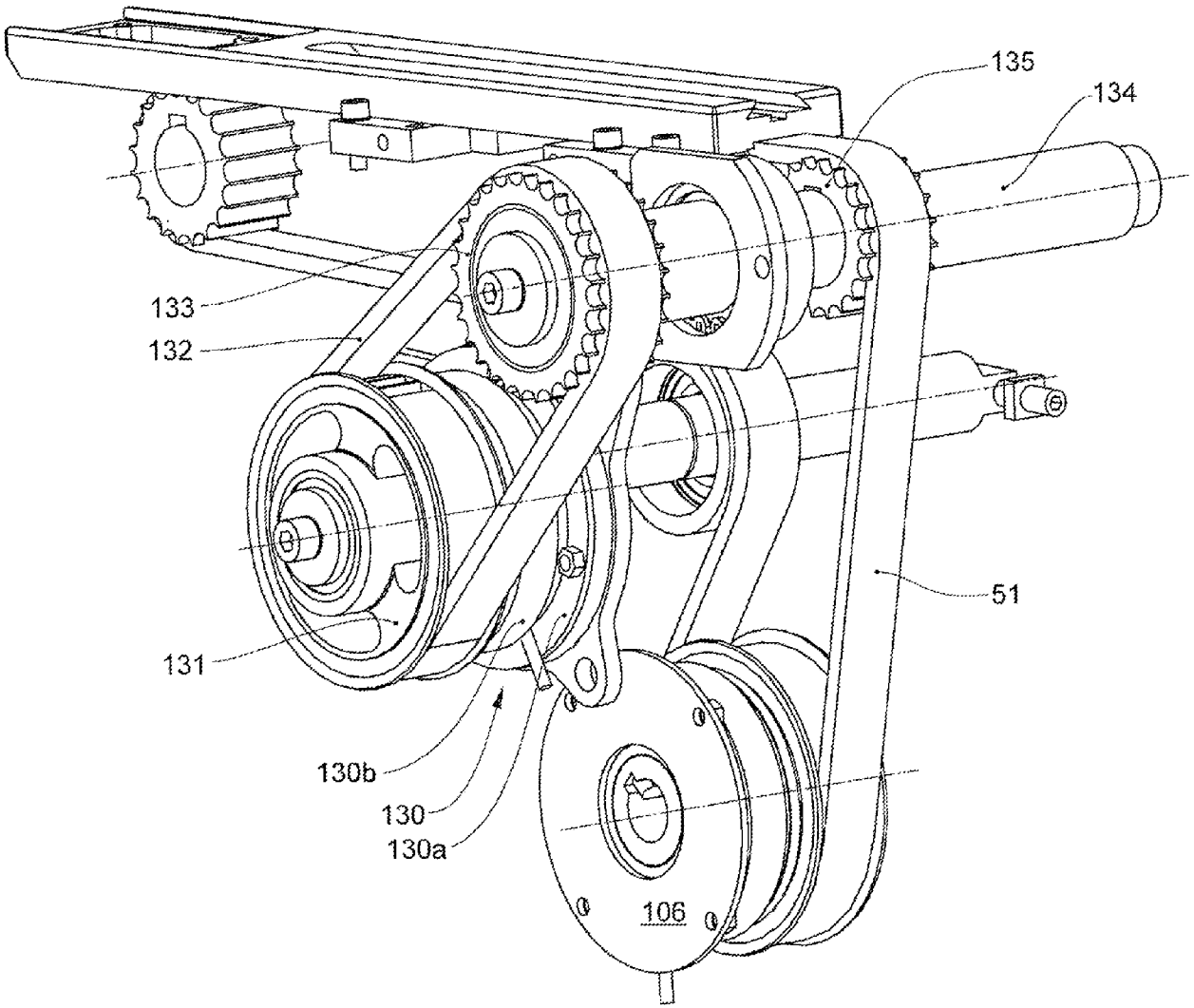
FIG. 13 a three-dimensional view of a second part of the energy storage mechanism used in FIG. 10 and FIG. 11 (viewed from the same side as in FIG. 12).

The third embodiment comprises an energy storage mechanism illustrated in FIG. 12 and FIG. 13. A first part of the energy storage mechanism is shown in FIG. 12 and comprises spring assemblies 120 which absorb, store and release kinetic energy. As it is absorbed, the kinetic energy is converted into potential energy, stored as potential energy, and converted back into kinetic energy as it is released. Alternatively, it may be intended that the kinetic energy is released at least in part as thermal energy, i.e. that a dissipation takes place.

Dissipation of at least a part of the kinetic energy to be absorbed in each cycle may be particularly slow, e.g. take several seconds or minutes. In particular, dissipation can contribute toward minimizing or preventing vibration of the mechanical parts.

A second part of the energy storage mechanism is illustrated in FIG. 13 and it comprises a second coupling 130, a pulley 131 and a gear 133 with freewheel. The second part of the energy storage mechanism can admit or prevent changes in the expansion of the spring assemblies 120 by way of the second coupling 130. Thus, following the absorption of kinetic energy, the spring assemblies 120 can store it as potential energy and release it again as kinetic energy according to choice of switchable option. Simultaneously, the second part of the energy storage mechanism serves as a retention element arresting the separation element 10 in the rear end position P1 according to choice of switchable option.

In the first part of the energy storage mechanism, the counter elements 72 are designed such that they are in force-fit contact with first ends of the spring assemblies 120 at least part of the time. The second ends of the spring assemblies 120 are force-fit connected to the casing 2. The spring assemblies 120 are fixed to the casing and can be preloaded variably with any chosen stress via pre-tensioners 121 in relation to the casing 2. While the counter elements 72 are located in the rear end position, where the separation element 10 connected to them via the toothed belt 51 must be located in its rear end position P1, the counter elements 72 compress the spring assemblies 120.

During a movement toward this rear end position (thus in the second half-cycle) the counter elements 72 compress the spring assemblies 120 increasingly, resulting in the spring assemblies 120 increasingly obstructing this movement. During a movement of the counter elements 72 away from this rear end position (thus in the first half-cycle) the stress of the spring assemblies 120 acts upon the counter elements 72 and supports the movement away from the rear end position. In this manner the kinetic energy of the counter elements 72 is converted into, and stored as potential energy in the rear end position during the second half-cycle, and during the subsequent first half-cycle converted back into kinetic energy and as such released to the counter elements 72. By means of the second part of the energy storage mechanism the counter elements 72 and thus too the spring assemblies 120 can be fixed or freely moved in their position according to choice. In this manner, the energy absorbed by the spring assemblies 120 can be absorbed, stored and released again.

The second part of the energy storage mechanism comprises the second coupling 130, which in turn comprises a coupling socket 130*a* firmly connected to the casing 2. A coupling disc 130*b* of the second coupling is firmly connected to a pulley 131, which in turn is connected to a toothed belt 132. The toothed belt 132 is connected to a gear 133 with freewheel, which in turn is connected to a deflection shaft 134. The deflection shaft 134 is firmly connected to a deflection gear 135 which deflects the toothed belt 51. The freewheel of the gear 133 is designed in such a manner that any rotation of the deflection shaft 134 occurring in the second half-cycle runs freely in relation to the gear 133. In the other direction, i.e. in any rotation of the deflection shaft 134 occurring in the first half-cycle, the gear 133 and the deflection shaft 134 engage with each other so that a gear 133 fixed in its position obstructs any rotation of the deflection shaft 134 and therefore hold it fast.

If operated, both couplings 106, 130 are only operated during the second half-cycle. Due to the corresponding freewheels no force acts upon the two couplings 106, 130 during the second half-cycle. When the two corresponding freewheels re-engage in the subsequent first half-cycle, the switching conditions of the two couplings 106, 130 decide upon whether the separation element 10 is moved or not. In the first half-cycle, the separation element 10 is moved from the rear end position P1 into the front end position P2 when the coupling 106 is activated (i.e. coupled) and the second coupling 130 is deactivated (decoupled). During accordingly temporally coordinated deactivation of the second coupling 130, the spring assemblies 120 release the stored energy from the start of the movement of the separation element 10 upon the return guide elements 70 and with it upon the separation element 10 in its direction of movement, thus supporting the movement of the separation element 10. If on the other hand the coupling 106 is not activated and the second coupling 130 is activated, the separation element 10 does not move and remains in the rear end position P1. Therein the kinetic energy absorbed by the spring assemblies 120 remains in storage in the form of potential energy.

If the separation element 10 has been moved into front end position P2 during the previous first half-cycle, the piston 53 moves the counter elements 72 by means of return guide elements 70 in the second half-cycle. With that, the separation element 10 is moved from the front end position P2 into the rear end position P1. Toward the end of this movement the counter elements 72 come onto force-fit contact with the spring assemblies 120 and compress them with increasing pressure until the end of the second half-cycle. If the separation element 10 has not been moved into front end position P2 during the previous first half-cycle, the separation element 10 is still located in the rear end position P1 and merely the piston 53 and the return guide elements 70 are moved but not the counter elements 72.

Should large and/or heavy items need to be separated from a stack, the supporting surface of the stack can be connected to the separation element and moved back and forth. Although the moved masses are then larger, the items are well supported at all times.

The invention claimed is:

1. A device for creating a controllable reciprocal movement of a moveable mechanical element between a first stop point (P1) and a second stop point (P2), wherein the device comprises:

at least one drive element that moves reciprocally between two turning points;

a coupling device with a controllable coupling for selective coupling of a mechanical element to the drive element;

wherein the coupling device features at least one freewheel and is designed in such a way that when the coupling is in its active state during a first half-cycle of the movement of at least one drive element, the mechanical element is coupled to the drive element and moved from the first stop point (P1) to the second stop point (P2), and during a second half-cycle of the movement of the drive element is substantially uninfluenced by the drive element due to the action of the freewheel; and wherein a return guide element, moves synchronously with the at least one drive element and is able to act on the mechanical element at least indirectly in such a way that the mechanical element is moved from the second stop point (P2) to the first stop point (P1) during the second half-cycle.

2. The device according to claim 1, wherein the return guide element is connected to the drive element.

3. The device according to claim 1, wherein the coupling device comprises the following features:

a shaft that is arranged so it can rotate;

the freewheel is situated between the shaft and the drive element, whereby a drive force is only transmitted to the shaft in one direction; and the controllable coupling couples the mechanical element selectively to the shaft.

4. The device according to claim 1, wherein the coupling device is arranged such that it moves with the mechanical element.

5. The device according to claim 4, wherein the mechanical element is a moveable carriage and the reciprocally moving drive element is a toothed belt which runs over a crown gear which is mounted in the carriage such that it can rotate over a freewheel, wherein by means of the controllable coupling the free rotation of the crown gear relative to the carriage can be blocked, whereby in the active state of the coupling, the carriage is moved by the toothed belt.

6. The device according to claim 5, wherein the return guide element is firmly connected to the toothed belt.

7. The device according to claim 1, wherein the coupling device is stationary.

8. The device according to claim 7, wherein the reciprocally-moving drive element is a piston, which is mounted on a stationary element such that it can rotate over the freewheel, that the piston is arranged coaxially with a crown gear, wherein a toothed belt, which is firmly connected to the mechanical element runs over the crown gear, and wherein the controllable coupling can block the free rotation of the crown gear relative to the piston, whereby the toothed belt and thus the mechanical element, is moved by the piston when the coupling is in an active state.

9. The device according to claim 8, wherein the return guide element is firmly connected to the piston.

10. The device according to claim 1, wherein there is an energy storage mechanism, which absorbs energy from moving parts of the device and releases the energy back to the same parts and can temporally store the energy and/or convert it into other forms of energy, wherein the energy storage mechanism absorbs, releases, and stores energy and/or converts it into other forms of energy when the mechanical element is near and/or in at least one of the stop points (P1, P2).

11. A singling device for controllable singling of items from a stack of items comprising:

at least one drive element that moves reciprocally between two turning points;

a coupling device with a controllable coupling for selective coupling of a mechanical element to the drive element;

wherein the coupling device features at least one freewheel and is designed in such a way that when the coupling is in its active state during a first half-cycle of the movement of at least one drive element, the mechanical element is coupled to the drive element and moved from the first stop point (P1) to the second stop point (P2), and during a second half-cycle of the movement of the drive element is substantially uninfluenced by the drive element due to the action of the freewheel; and wherein a return guide element, moves synchronously with the at least one drive element and is able to act on the mechanical element) at least indirectly in such a way that the mechanical element is moved from the second stop point (P2) to the first stop point (P1) during the second half-cycle as well as a stack feeder, wherein the mechanical element is designed as a separation element, which is able to interact with one item of the stack that is arranged in the stack feeder and separate this item from the stack by moving the item between the first stop point (P1) and the second stop point (P2).

12. A method for creating a controllable reciprocal movement of a moveable mechanical element between a first stop point (P1) and a second stop point (P2) comprising the steps:

creating continual reciprocal movement of at least one drive element in a first half cycle between a first and a second turning point as well as in a second half-cycle from the second to the first turning point;

selectively coupling of the mechanical element to the drive element by means of a controllable coupling, wherein when the coupling is in its active state in the first half-cycle of the drive element the mechanical element is taken along and moved from the first stop point (P1) to the second stop point (P2);

fundamentally decoupling of the mechanical element from the drive element in the second half-cycle by means of a freewheel, whereby the coupling is unloaded during the second half-cycle;

creating return movement of the mechanical element.

13. The method according to claim 11, wherein the coupling is only activated and/or deactivated during the second half-cycle.

14. Method according to claim 12, wherein energy from the movement of the mechanical element is absorbed and temporally stored and/or converted into different forms of energy, wherein this takes place during an approach to one of the turning points and/or in one of the turning points.

15. Method according to claim 14, wherein temporally stored energy from the movement of the mechanical element is at least partly released back to the mechanical element and/or converted into different forms of energy, and is released back to the mechanical element as movement, wherein this takes place particularly during a movement away from a turning point and/or in one of the turning points.

* * * * *